US010730341B2

(12) United States Patent
Andresen

(10) Patent No.: US 10,730,341 B2
(45) Date of Patent: Aug. 4, 2020

(54) PAINT TRAY

(71) Applicant: Dee Lynn Andresen, Kiowa, CO (US)

(72) Inventor: Dee Lynn Andresen, Kiowa, CO (US)

( * ) Notice: Subject to any disclaimer, the term of this patent is extended or adjusted under 35 U.S.C. 154(b) by 29 days.

(21) Appl. No.: 16/132,352

(22) Filed: Sep. 14, 2018

(65) Prior Publication Data

US 2019/0023063 A1 Jan. 24, 2019

Related U.S. Application Data

(63) Continuation-in-part of application No. 15/521,911, filed as application No. PCT/IB2015/058856 on Nov. 16, 2015, now abandoned.

(60) Provisional application No. 62/080,036, filed on Nov. 14, 2014.

(51) Int. Cl.

| | |
|---|---|
| ***B05C 21/00*** | (2006.01) |
| ***B44D 3/12*** | (2006.01) |
| ***B05C 17/02*** | (2006.01) |

(52) U.S. Cl.

CPC ..... *B44D 3/126* (2013.01); *B05C 17/0245* (2013.01); *B05C 21/00* (2013.01)

(58) Field of Classification Search

CPC ..... B05C 17/0245; B05C 21/00; B44D 3/126
USPC ..... D32/53.1
See application file for complete search history.

(56) References Cited

U.S. PATENT DOCUMENTS

| | | | | |
|---|---|---|---|---|
| 3,380,100 A | | 4/1968 | Pharris et al. | |
| 4,164,803 A | | 8/1979 | Zurawin et al. | |
| 4,509,226 A | * | 4/1985 | Allison | B44D 3/126 15/257.06 |
| D328,808 S | * | 8/1992 | Goetz | D32/53.1 |
| 5,139,139 A | | 8/1992 | Goetz | |
| 5,509,169 A | | 4/1996 | Drucker | |
| 5,735,399 A | | 4/1998 | Ste. Marie | |
| 6,276,554 B1 | | 8/2001 | Lallement et al. | |
| 6,471,086 B1 | | 10/2002 | Fleckenstein | |
| 6,622,884 B1 | | 9/2003 | Gartner | |
| 6,851,570 B2 | | 2/2005 | Janssen | |
| 8,701,242 B2 | * | 4/2014 | DeHart | B44D 3/126 15/257.05 |
| 2006/0260086 A1 | | 11/2006 | Boehm | |

FOREIGN PATENT DOCUMENTS

FR 2 322 754 A1 4/1977

* cited by examiner

*Primary Examiner* — Randall E Chin
(74) *Attorney, Agent, or Firm* — Inventech Patent Services, LLC; Marc A. Scharich

(57) ABSTRACT

A paint tray includes front and rear walls, first and second side walls, a bottom wall and an inclined ramp. The inclined ramp includes first and second raised runners protruding from the inclined ramp so as to be raised relative to a central portion of the inclined ramp. A recessed space is defined between the first and second raised runners and the central portion of the inclined ramp. The paint tray further includes a well and first and second recessed gutters for directing paint into the well. The paint tray is configured such that when a paint roller cover is rolled along the inclined ramp, the first and second raised runners, together with the recessed space of the inclined ramp, increase the amount of paint distributed onto a center portion of the paint roller cover and decrease the amount of paint distributed onto ends of the paint roller cover.

20 Claims, 7 Drawing Sheets

PAINT TRAY

CROSS-REFERENCE TO RELATED APPLICATIONS

This application is a continuation-in-part of co-pending U.S. application Ser. No. 15/521,911, entitled "Improved Paint Roller Paint Tray" and filed Apr. 26, 2017, which is the U.S. National Stage Entry of PCT International Application Ser. No. PCT/IB2015/058856, entitled "Improved Paint Roller Paint Tray" and filed Nov. 16, 2015, which claims the benefit of U.S. Provisional Application Ser. No. 62/080,036, entitled "Improved Paint Roller Paint Tray" and filed Nov. 14, 2014. Each of the above-referenced applications, including their respective disclosures, are hereby incorporated by reference in their entireties for all purposes.

TECHNICAL FIELD

The present invention generally relates to painting tools and, more particularly, to a paint tray capable of increasing the amount of paint distributed onto a center portion of a paint roller cover and decreasing the amount of paint distributed onto ends of the paint roller cover when the paint roller cover is rolled along an inclined ramp of the paint tray.

BACKGROUND

Various painting tools are commonly used by homeowners and professionals for painting surfaces such as walls, ceilings, floors and other paintable surfaces. More specifically, various conventional paint trays are commonly used for holding paint which is distributable onto a paint roller cover installed onto a paint roller frame. While painting, a user will typically grasp a handle or extension pole attached to the paint roller frame and roll the paint roller cover within a paint tray to load paint onto the paint roller cover, thereby distributing the paint onto the paint roller cover before applying the paint onto a paintable surface. The use of conventional paint trays which are currently available on the market, however, often presents several limitations, challenges and disadvantages during painting. For example, conventional paint trays often have shallow or short wells formed therein which do not hold an adequate amount of paint, therefore making it necessary for a user to stop painting and keep refilling the well with additional paint more often than desired. Additionally, conventional paint trays are often flimsy and not well-constructed, making it difficult for a user to hold or transport the paint tray during use, which may further result in paint being spilled from the paint tray or the paint tray being dropped. Furthermore, conventional paint trays typically have flat ramps which, in conjunction with the back and forth rolling action of the paint roller cover along the ramp during loading, often cause excess paint to be distributed towards the ends and side edges of the paint roller cover. Such excess paint being distributed and collected at or near the ends and side edges of the paint roller cover may cause several unwanted problems or occurrences during painting. For example, when excess paint is distributed and collected at or near the ends and side edges of the paint roller cover, the paint loaded onto the paint roller cover may be applied unevenly onto the paintable surface, resulting in unwanted markings or paint lines (i.e. from the ends of the paint roller cover) appearing on the paintable surface. Furthermore, excess paint being distributed and collected at or near the ends and side edges of the paint roller cover may lead to unwanted paint splatter, paint dripping off the ends of the paint roller cover and/or paint roller frame (e.g. when the paint roller cover is turned vertically sideways when painting around baseboards) or may lead to unwanted masses of paint (e.g. "whips") spinning or whipping off the ends of the paint roller cover and/or paint roller frame. Additionally, flat ramps of conventional paint trays often act against the nap of the paint roller cover in such a way as to flatten the nap and limit the amount of paint which may be absorbed by the paint roller cover, therefore making it necessary for a user to stop painting and keep reloading the paint roller cover more often than desired. Furthermore, conventional paint trays often lack adequate features capable of supporting a handle or other parts of a paint roller frame when the paint roller frame is not in use.

With the aforementioned limitations, challenges and disadvantages relating to the use of conventional paint trays in mind, there is a continuing unaddressed need for a paint tray which is well-constructed and more user-friendly than convention paint trays and which enables a user to paint with a paint roller frame and paint roller cover more efficiently, cleanly and productively while achieving improved paint roller cover performance and better paint application onto a painted surface.

SUMMARY

The above-mentioned need is addressed with the present invention. One aspect of this invention is directed to a paint tray for holding paint which is distributable onto a paint roller cover. The paint tray includes a front wall disposed at a front end of the paint tray, a rear wall disposed at a rear end of the paint tray, first and second side walls extending longitudinally between the front and rear walls and connected to the front and rear walls, a bottom wall connected to the rear wall and to the first and second side walls, and an inclined ramp extending upwardly from the bottom wall and towards the front wall. The inclined ramp includes a first raised runner extending upwardly along the inclined ramp and towards the front wall. The first raised runner has a lateral width thereof which is greater than a vertical height thereof. The first raised runner protrudes from the inclined ramp so as to be raised relative to a central portion of the inclined ramp. The inclined ramp further includes a second raised runner laterally spaced apart from the first raised runner and extending upwardly along the inclined ramp and towards the front wall. The second raised runner has a lateral width thereof which is greater than a vertical height thereof. The second raised runner protrudes from the inclined ramp so as to be raised relative to the central portion of the inclined ramp. The inclined ramp further includes a recessed space defined between at least inner sides of the first and second raised runners and the central portion of the inclined ramp. The paint tray further includes a well including the bottom wall and bounded by at least the rear wall, the first and second side walls and the inclined ramp. The well defines a region configured to hold paint pooled in the paint tray. The paint tray further includes a first recessed gutter formed between the first side wall and the inclined ramp. The first recessed gutter is configured to direct paint received therein into the well. The paint tray further includes a second recessed gutter formed between the second side wall and the inclined ramp. The second recessed gutter is configured to direct paint received therein into the well. The paint tray is configured such that when a paint roller cover is rolled along the inclined ramp, the first and second raised runners, together with the recessed space of the inclined ramp, increase the amount of paint distributed onto a center portion of the paint roller cover and decrease the amount of paint distributed onto ends of the paint roller cover.

Another aspect of this invention is directed to a paint tray for holding paint which is distributable onto a paint roller cover. The paint tray includes a front wall disposed at a front end of the paint tray, a rear wall disposed at a rear end of the paint tray, first and second side walls extending longitudinally between the front and rear walls and connected to the front and rear walls, a bottom wall connected to a lower edge of the rear wall and to lower edges of the first and second side walls, and an inclined ramp extending from the bottom wall to an inner surface of the front wall. The inclined ramp includes a lower angled ramp face extending upwardly from the bottom wall at a first angle and an upper angled ramp face connected to the lower angled ramp face and extending upwardly from the lower angled ramp face at a second angle which is different from the first angle. The upper angled ramp face extends to the inner surface of the front wall. The inclined ramp further includes a first raised runner extending from the bottom wall to the inner surface of the front wall. The first raised runner has a lateral width thereof which is greater than a vertical height thereof. The first raised runner includes a first lower runner disposed on the lower angled ramp face and protruding from the lower angled ramp face so as to be raised relative to a central portion of the lower angled ramp face. The first raised runner further includes a first upper runner connected to the first lower runner and disposed on the upper angled ramp face. The first upper runner protrudes from the upper angled ramp face so as to be raised relative to a central portion of the upper angled ramp face. The first upper runner extends to the inner surface of the front wall. The inclined ramp further includes a second raised runner laterally spaced apart from the first raised runner and extending from the bottom wall to the inner surface of the front wall. The second raised runner has a lateral width thereof which is greater than a vertical height thereof. The second raised runner includes a second lower runner disposed on the lower angled ramp face and protruding from the lower angled ramp face so as to be raised relative to the central portion of the lower angled ramp face. The second raised runner further includes a second upper runner connected to the second lower runner and disposed on the upper angled ramp face. The second upper runner protrudes from the upper angled ramp face so as to be raised relative to the central portion of the upper angled ramp face. The second upper runner extends to the inner surface of the front wall. The inclined ramp further includes a recessed space defined between at least inner sides of the first and second raised runners and the central portions of the lower angled ramp face and the upper angled ramp face. The paint tray further includes a well including the bottom wall and bounded by at least the rear wall, the first and second side walls, the first and second lower runners protruding from the lower angled ramp face and the central portion of the lower angled ramp face. The well defines a region configured to hold paint pooled in the paint tray. The paint tray further includes a first recessed gutter formed between the first side wall and the inclined ramp. The first recessed gutter is configured to direct paint received therein into the well. The paint tray further includes a second recessed gutter formed between the second side wall and the inclined ramp. The second recessed gutter is configured to direct paint received therein into the well. The paint tray is configured such that when a paint roller cover is rolled along the inclined ramp, the first and second raised runners, together with the recessed space of the inclined ramp, increase the amount of paint distributed onto a center portion of the paint roller cover and decrease the amount of paint distributed onto ends of the paint roller cover.

BRIEF DESCRIPTION OF THE DRAWINGS

One or more embodiments of the present invention are pointed out with particularity in the appended claims. However, other features of the one or more embodiments will become more apparent and will be best understood by referring to the following detailed description in conjunction with the accompanying drawings, wherein:

DETAILED DESCRIPTION

Figure 1:
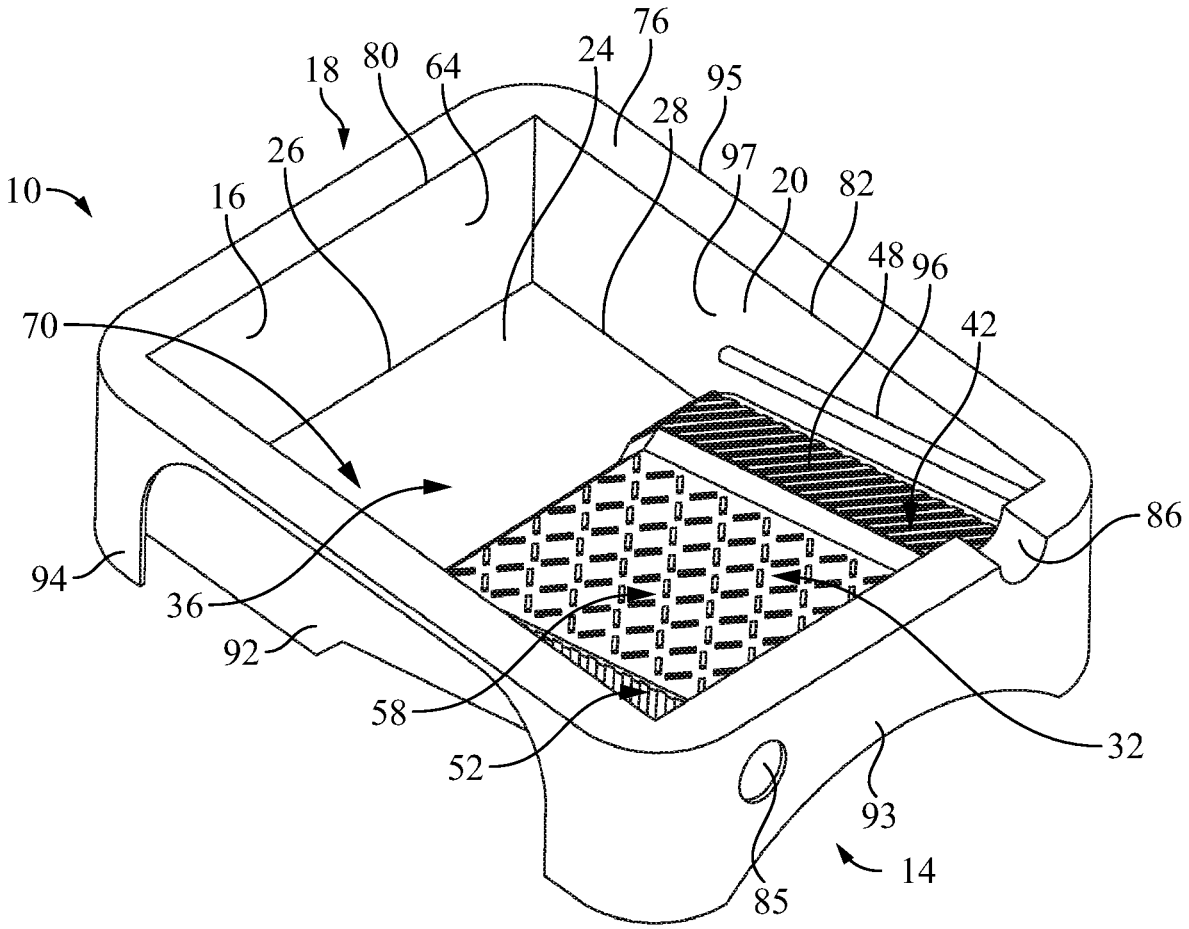
FIG. 1 is a front perspective view of a paint tray according to the present invention.

As required, one or more detailed embodiments of the present invention are disclosed herein, however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention. Various terms and/or phrases describing or indicating a reference or position such as "top", "bottom", "front", "rear", etc. relate to the invention as seen from a user's vantage point during use, and such terms and/or phrases are not to be interpreted as limiting, but merely as a representative basis for describing the invention to one skilled in the art.

Referring to FIGS. 1-9, a paint tray 10 (FIGS. 1-8) for holding paint which is distributable onto a paint roller cover 100 (FIG. 9) is shown and described. The paint tray 10 includes a front wall 12 disposed at a front end 14 of the paint tray 10, a rear wall 16 disposed at a rear end 18 of the paint tray 10, first and second side walls 20, 22 extending longitudinally between the front and rear walls 12, 16 and connected to the front and rear walls 12, 16, and a bottom wall 24 connected to a lower edge 26 of the rear wall 16 and to respective lower edges 28, 30 of the first and second side walls 20, 22.

Additionally, the paint tray 10 further includes an inclined ramp 32 extending upwardly from the bottom wall 24 and towards the front wall 12 to an inner surface 34 of the front wall 12. The paint roller cover 100 may engage with and be rolled along the inclined ramp 32 when loading the paint roller cover 100 with paint (as will be further described herein). The front wall 12, rear wall 16, first and second side walls 20, 22, bottom wall 24 and inclined ramp 32 define an interior space 36 of the paint tray 10. As seen in at least FIG. 2, the inclined ramp 32 includes a lower angled ramp face 38 extending upwardly from the bottom wall 24 at a first angle and an upper angled ramp face 40 connected to the lower angled ramp face 38 and extending upwardly from the lower angled ramp face 38 at a second angle which is different from the first angle. The upper angled ramp face 40 extends towards the front wall 12 to the inner surface 34 of the front wall 12. While the lower angled ramp face 38 and upper angled ramp face 40 are shown and described, it is to be understood by one skilled in the art that the inclined ramp 32 may include a single ramp face (not shown) which extends upwardly from the bottom wall 24 and towards the front wall 12 to the inner surface 34 of the front wall 12.

Figure 2:
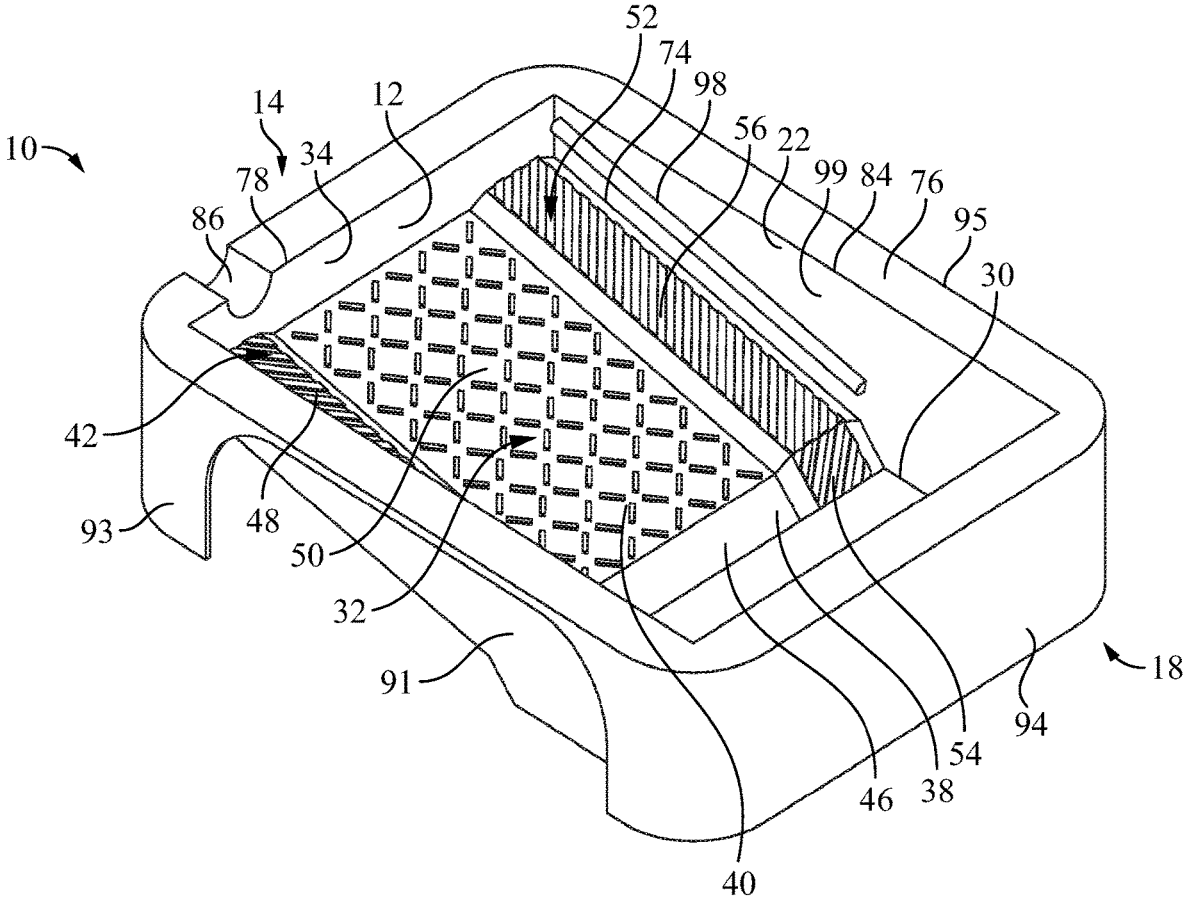
FIG. 2 is a rear perspective view of the paint tray according to the present invention.
Figure 3:
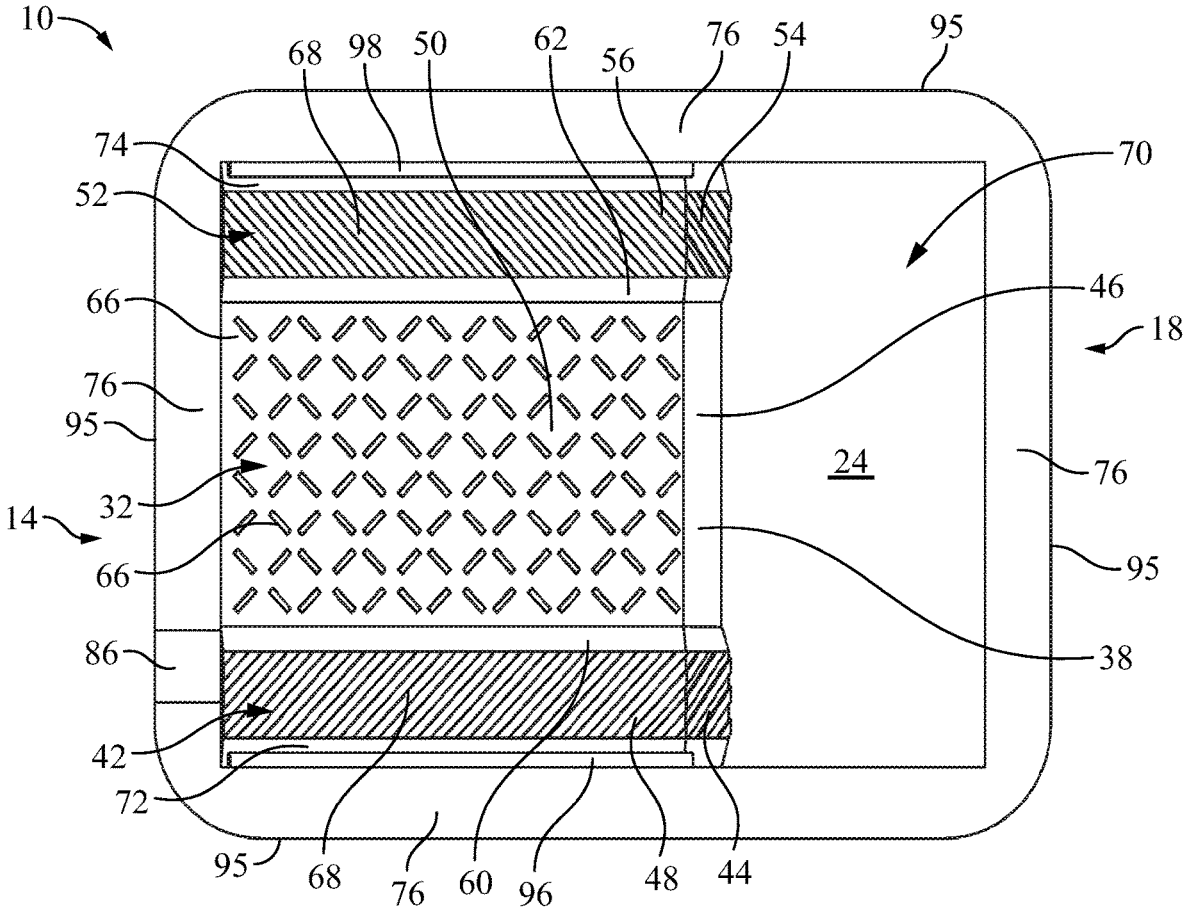
FIG. 3 is a top plan view of the paint tray according to the present invention.

Additionally, the inclined ramp 32 further includes a first raised runner 42 extending upwardly from the bottom wall 24 and towards the front wall 12 to the inner surface 34 of the front wall 12. Preferably, the first raised runner 42 has a lateral width thereof which is greater than a vertical height thereof so as to advantageously be capable of engaging a larger surface area of the paint roller cover 100 at one end of the paint roller cover 100 when the paint roller cover 100 is rolled along the inclined ramp 32 (as will be further discussed herein). The first raised runner 42 includes a first lower runner 44 disposed on the lower angled ramp face 38 and protruding from the lower angled ramp face 38 so as to be raised relative to a central portion 46 of the lower angled ramp face 38. The first raised runner 42 further includes a first upper runner 48 connected to the first lower runner 44 and disposed on the upper angled ramp face 40. The first upper runner 48 protrudes from the upper angled ramp face 40 so as to be raised relative to a central portion 50 of the upper angled ramp face 40. As seen in FIGS. 2 and 3, the first upper runner 48 extends to the inner surface 34 of the front wall 12.

Additionally, the inclined ramp 32 further includes a second raised runner 52 laterally spaced apart from the first raised runner 42. The second raised runner 52 extends upwardly from the bottom wall 24 and towards the front wall 12 to the inner surface 34 of the front wall 12. Preferably, the second raised runner 52 has a lateral width thereof which is greater than a vertical height thereof so as to advantageously be capable of engaging a larger surface area of the paint roller cover 100 at another end of the paint roller cover 100 when the paint roller cover 100 is rolled along the inclined ramp 32 (as will be further discussed herein). The second raised runner 52 includes a second lower runner 54 disposed on the lower angled ramp face 38 and protruding from the lower angled ramp face 38 so as to be raised relative to the central portion 46 of the lower angled ramp face 38. The second raised runner 52 further includes a second upper runner 56 connected to the second lower runner 54 and disposed on the upper angled ramp face 40. The second upper runner 56 protrudes from the upper angled ramp face 40 so as to be raised relative to the central portion 50 of the upper angled ramp face 40. As seen in FIGS. 2 and 3, the second upper runner 56 extends to the inner surface 34 of the front wall 12. As seen in at least FIG. 3, preferably, the first and second raised runners 42, 52 of the inclined ramp 32 are disposed parallel to each other so as to advantageously be capable of aligning with the ends of the paint roller cover 100 when the paint roller cover 100 is rolled along the inclined ramp 32 (as will be further described herein). Furthermore, the first and second raised runners 42, 52 of the inclined ramp 32 are disposed parallel to the first and second side walls 20, 22. Additionally, as will be further discussed herein, the inclined ramp 32 further includes a recessed space 58 defined between at least respective inner sides 60, 62 of the first and second raised runners 42, 52 and the respective central portions 46, 50 of the lower angled ramp face 38 and the upper angled ramp face 40. While the first and second raised runners 42, 52 are shown and described as extending upwardly from the bottom wall 24, it is to be understood by one skilled in the art that the first and second raised runners 42, 52 may extend along the entire length of the interior space 36 from an inner surface 64 of the rear wall 16 to the inner surface 34 of the front wall 12.

Additionally, the inclined ramp 32 further includes a plurality of ramp treads 66 configured to increase traction between the paint roller cover 100 and the inclined ramp 32, thereby causing the paint roller cover 100 to spin when the paint roller cover 100 is rolled along the inclined ramp 32. The plurality of ramp treads 66 may be of any suitable shape, thickness and/or size. Furthermore, the first and second raised runners 42, 52 of the inclined ramp 32 further include a plurality of runner treads 68 configured to increase traction between the paint roller cover 100 and the inclined ramp 32, thereby causing the paint roller cover 100 to spin when the paint roller cover 100 is rolled along the inclined ramp 32. The plurality of runner treads 68 may be of any suitable shape, thickness and/or size Additionally, the paint tray 10 further includes a well 70 including the bottom wall 24 and bounded by at least the rear wall 16, the first and second side walls 20, 22, the first and second lower runners 44, 54 protruding from the lower angled ramp face 38 and the central portion 46 of the lower angled ramp face 38. The well 70 defines a region configured to hold paint pooled in the paint tray 10. Preferably, the well 70 may be sized so as the be longer and/or deeper than wells in conventional paint trays familiar to those skilled in the art so as to be capable of holding more paint than such conventional paint trays.

Additionally, the paint tray 10 further includes a first recessed gutter 72 formed between the first side wall 20 and the inclined ramp 32. The first recessed gutter 72 is configured to direct paint received therein into the well 70. The paint tray 10 further includes a second recessed gutter 74 formed between the second side wall 22 and the inclined ramp 32. The second recessed gutter 74 is configured to direct paint received therein into the well 70.

Additionally, the paint tray 10 further includes a lip 76 connected to respective upper edges 78, 80 of the front and rear walls 12, 16 and to respective upper edges 82, 84 of the first and second side walls 20, 22. The lip 76 extends outwardly from the front and rear walls 12, 16 and outwardly from the first and second side walls 20, 22. The lip 76 includes at least one concave rest 86 formed thereon configured to support a handle 110 of a paint roller frame 108 (FIG. 9) when the paint roller frame 108 is not in use.

Figure 4:
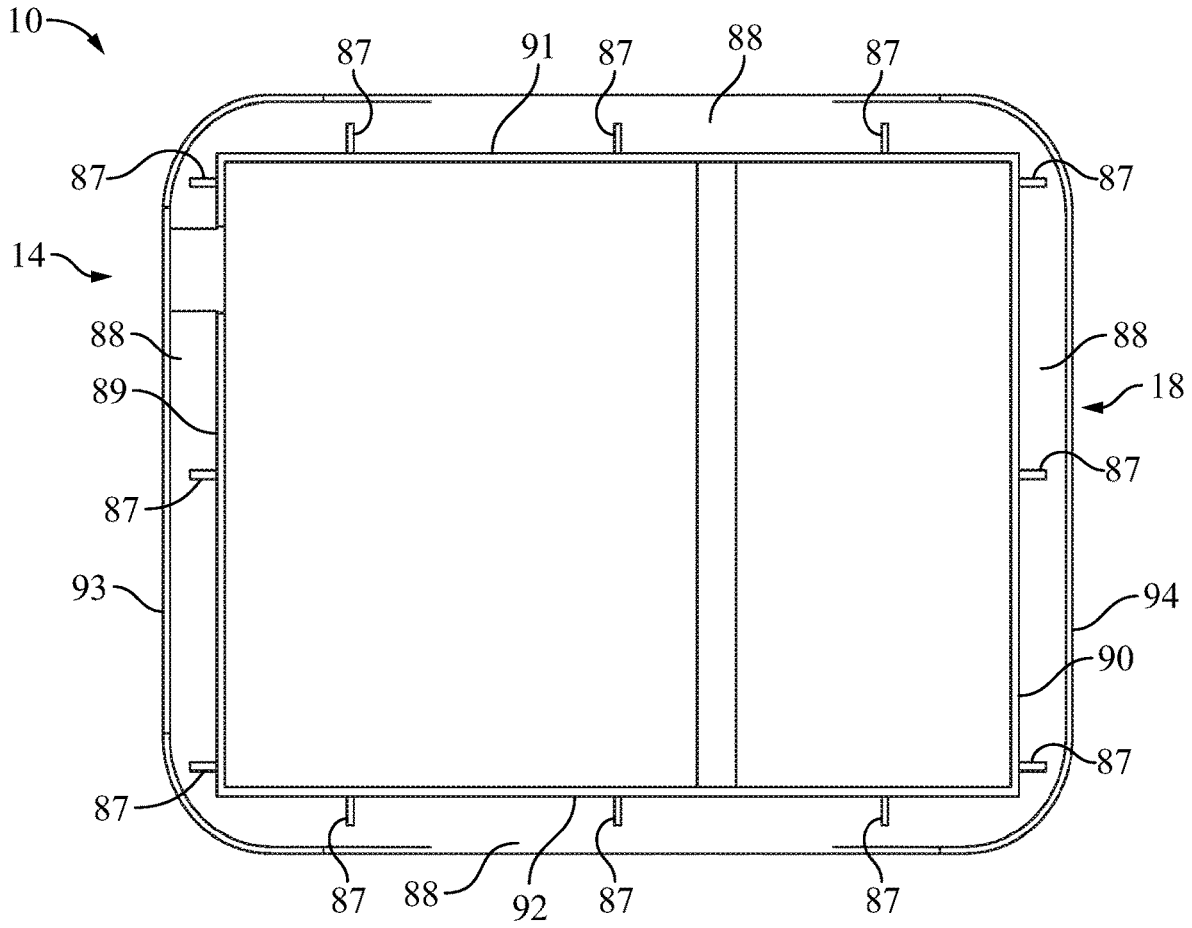
FIG. 4 is a bottom plan view of the paint tray according to the present invention.
Figure 5:
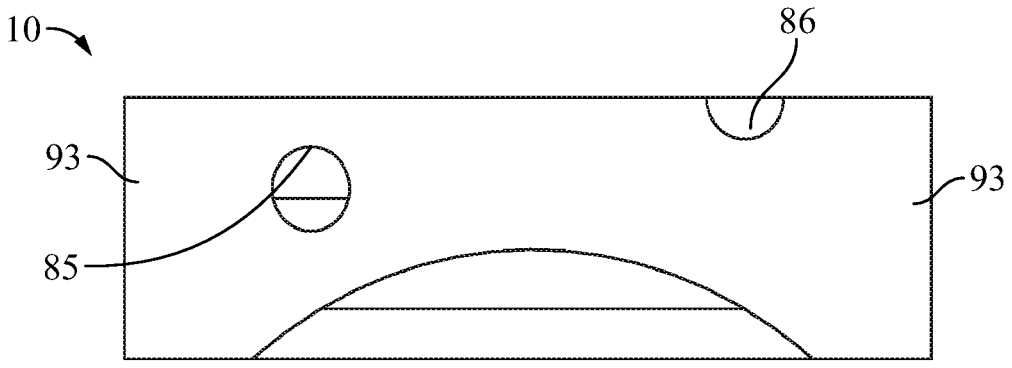
FIG. 5 is a front view of the paint tray according to the present invention.
Figure 6:
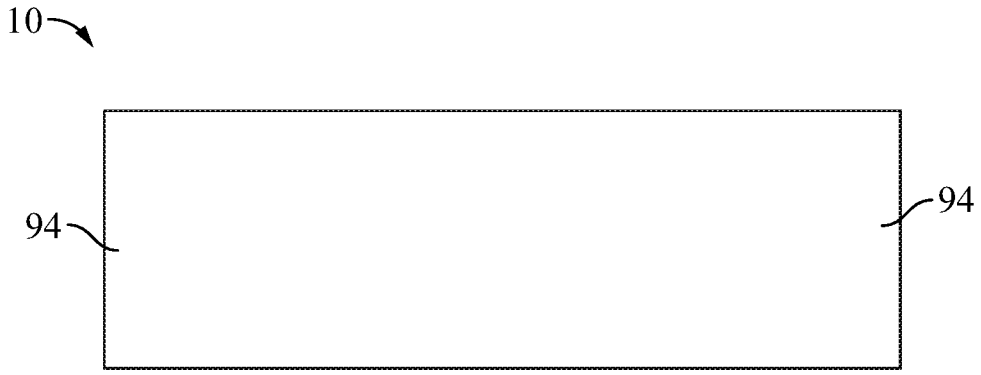
FIG. 6 is a rear view of the paint tray according to the present invention.
Figure 7:
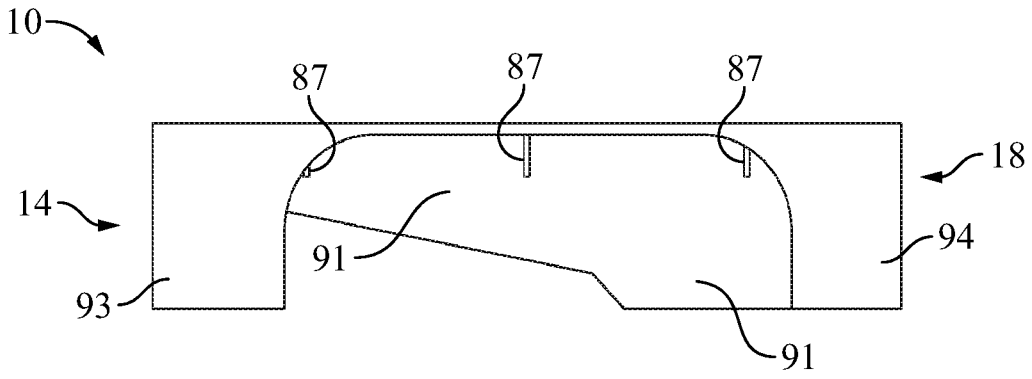
FIG. 7 is a first side view of the paint tray according to the present invention.
Figure 8:
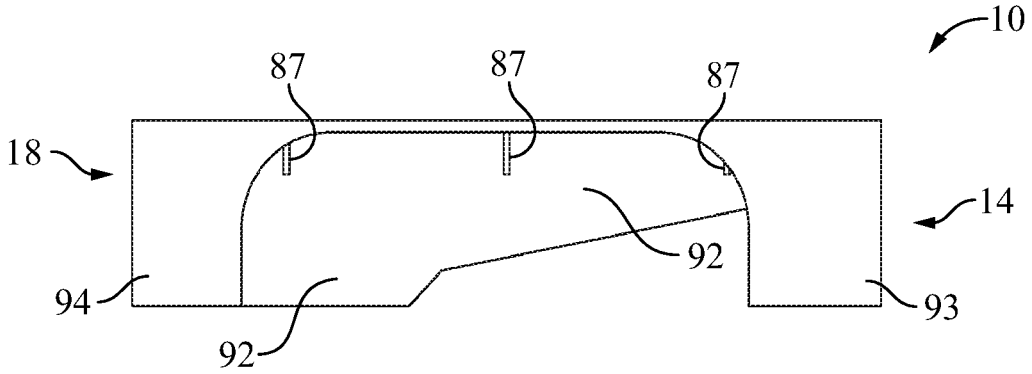
FIG. 8 is a second side view of the paint tray according to the present invention.

Additionally, as seen in FIG. 4 the paint tray 10 further includes a plurality of structural reinforcement ribs 87 connected to a bottom surface 88 of the lip 76, respective outer surfaces 89, 90 of the front and rear walls 12, 16 and respective outer surfaces 91, 92 of the first and second side walls 20, 22.

Additionally, the paint tray 10 further includes a plurality of feet 93, 94 connected to an outer edge 95 of the lip 76 and extending downwardly from the outer edge 95 of the lip 76. The plurality of feet 93, 94 are configured to support and stabilize the paint tray 10 on a support surface on which the paint tray 10 is placed, and may be grasped so as to enable a user to easily hold or transport the paint tray 10 during use. One foot 93 may include a circular boom hole 85 to which a boom or long handle may be hooked to allow the paint tray 10 to be easily slid by a user at a distance away from the paint tray 10.

Additionally, the paint tray 10 may optionally include a first elongate bumper 96 connected to an inner surface 97 of the first side wall 20 and disposed adjacent to the first raised runner 42 of the inclined ramp 32 and a second elongate bumper 98 connected to an inner surface 99 of the second side wall 22 and disposed adjacent to the second raised runner 52 of the inclined ramp 32. The first and second elongate bumpers 96, 98 are configured to wipe excess paint from at least side edges of the paint roller cover 100 when the paint roller cover 100 is rolled along the inclined ramp 32.

The paint tray 10 may be made of any suitable material, such as an injection molded or thermoformed polymer (e.g. recycled polypropylene), or alternatively, may be made from a stamped metal (e.g. aluminum).

Figure 9:
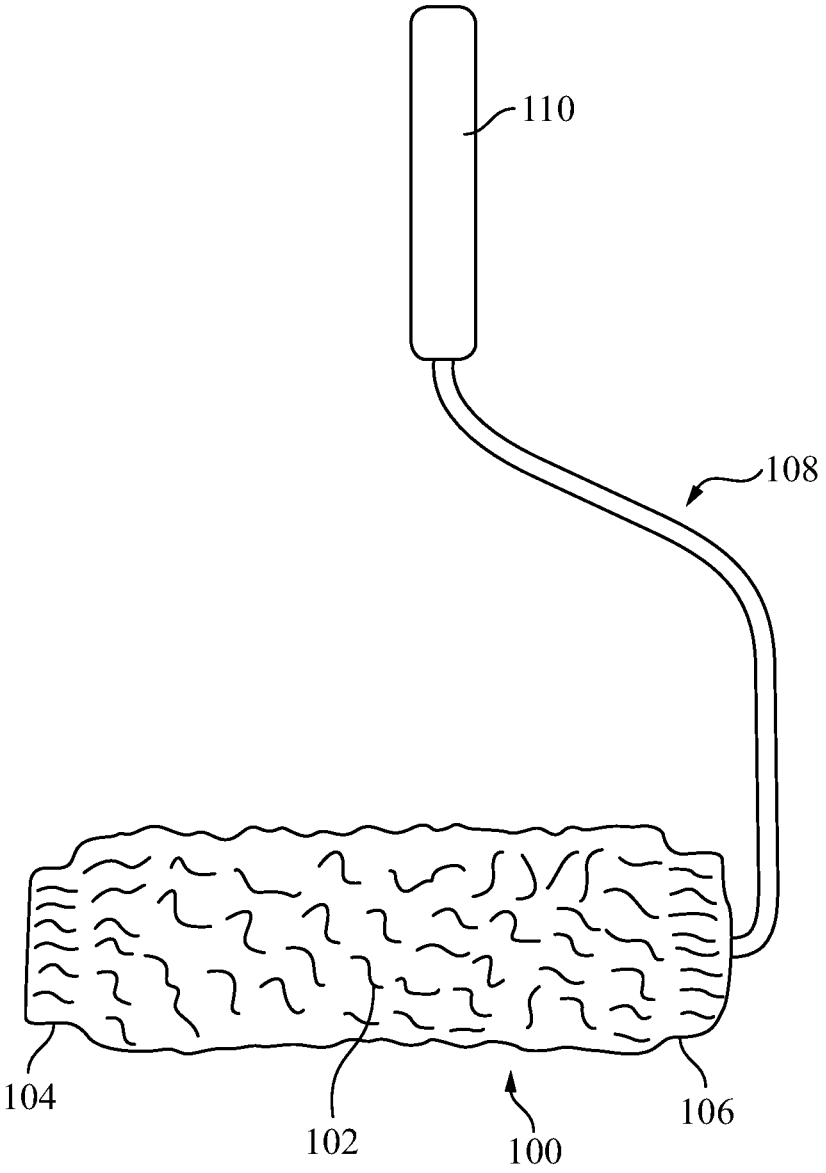
FIG. 9 is a front view of a paint roller cover installed onto a paint roller frame illustrating paint distribution along the paint roller cover after being rolled along an inclined ramp of the paint tray according to the present invention and loaded with paint.

In use, the paint tray 10 is configured such that when the paint roller cover 100 is rolled along the inclined ramp 32, the first and second raised runners 42, 52, together with the recessed space 58 of the inclined ramp 32, increase the amount of paint distributed onto a center portion 102 of the paint roller cover 100 and decrease the amount of paint distributed onto ends 104, 106 of the paint roller cover 100 (as shown in FIG. 9). Such a paint distribution onto the paint roller cover 100 reduces or eliminates unwanted paint markings or lines (i.e. from the ends 104, 106 of the paint roller cover 100) appearing on a paintable surface, and reduces or eliminates splatter, paint dripping off the ends 104, 106 of the paint roller cover 100 and/or paint roller frame 108 (e.g. when the paint roller cover 100 is turned vertically sideways when painting around baseboards) or reduces or eliminates unwanted masses of paint (e.g. "whips") spinning or whipping off the ends 104, 106 of the paint roller cover 100. Furthermore, since the recessed space 58 of the inclined ramp 32 permits more paint to be distributed and absorbed onto the center portion 102 of the paint roller cover 100, a user is able to keep the paint roller cover 100 rolling on the paintable surface for a longer duration, therefore enabling the painting process to be more productive and efficient.

While one or more exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It should be further understood that certain steps could be performed simultaneously, that other steps could be added, or that certain steps described herein could be omitted. In other words, the descriptions of processes described above are provided for the purpose of illustrating certain embodiments, and should in no way be construed so as to limit the claims.

As used in this specification and claims, the terms "for example"/"e.g.", "for instance", "such as", and "like", and the verbs "comprising", "having", "including", and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

Having thus described the invention, what is claimed is:

1. A paint tray for holding paint which is distributable onto a paint roller cover, the paint tray comprising:

a front wall disposed at a front end of the paint tray;

a rear wall disposed at a rear end of the paint tray;

first and second side walls extending longitudinally between the front and rear walls and connected to the front and rear walls;

a bottom wall connected to the rear wall and to the first and second side walls;

an inclined ramp extending upwardly from the bottom wall and towards the front wall, the inclined ramp including:

a first raised runner extending upwardly along the inclined ramp and towards the front wall, the first raised runner having a lateral width thereof being greater than a vertical height thereof, the first raised runner protruding from the inclined ramp so as to be raised relative to a central portion of the inclined ramp;

a second raised runner laterally spaced apart from the first raised runner and extending upwardly along the inclined ramp and towards the front wall, the second raised runner having a lateral width thereof being greater than a vertical height thereof, the second raised runner protruding from the inclined ramp so as to be raised relative to the central portion of the inclined ramp; and a recessed space defined between at least inner sides of the first and second raised runners and the central portion of the inclined ramp;

the paint tray further comprising:

a well including the bottom wall and bounded by at least the rear wall, the first and second side walls and the inclined ramp, the well defining a region configured to hold paint pooled in the paint tray;

a first recessed gutter formed between the first side wall and the inclined ramp, the first recessed gutter configured to direct paint received therein into the well; and a second recessed gutter formed between the second side wall and the inclined ramp, the second recessed gutter configured to direct paint received therein into the well;

wherein the paint tray is configured such that when a paint roller cover is rolled along the inclined ramp, the first and second raised runners, together with the recessed space of the inclined ramp, increase the amount of paint distributed onto a center portion of the paint roller cover and decrease the amount of paint distributed onto ends of the paint roller cover.

2. The paint tray according to claim 1, wherein the first and second raised runners of the inclined ramp are disposed parallel to each other.

3. The paint tray according to claim 1, wherein the first and second raised runners of the inclined ramp are disposed parallel to the first and second side walls.

4. The paint tray according to claim 1, wherein the inclined ramp further includes a plurality of ramp treads configured to increase traction between the paint roller cover and the inclined ramp, thereby causing the paint roller cover to spin when the paint roller cover is rolled along the inclined ramp.

5. The paint tray according to claim 1, wherein each of the first and second raised runners of the inclined ramp include a plurality of runner treads configured to increase traction between the paint roller cover and the inclined ramp, thereby causing the paint roller cover to spin when the paint roller cover is rolled along the inclined ramp.

6. The paint tray according to claim 1, further comprising a first elongate bumper connected to an inner surface of the first side wall and disposed adjacent to the first raised runner of the inclined ramp and a second elongate bumper connected to an inner surface of the second side wall and disposed adjacent to the second raised runner of the inclined ramp, the first and second elongate bumpers configured to wipe excess paint from at least side edges of the paint roller cover when the paint roller cover is rolled along the inclined ramp.

7. The paint tray according to claim 1, further comprising a lip connected to upper edges of the front and rear walls and to upper edges of the first and second side walls, the lip extending outwardly from the front and rear walls and the first and second side walls.

8. The paint tray according to claim 7, wherein the lip includes at least one concave rest formed thereon configured to support a handle of a paint roller frame when the paint roller frame is not in use.

9. The paint tray according to claim 7, further comprising a plurality of structural reinforcement ribs connected to a bottom surface of the lip, outer surfaces of the front and rear walls and outer surfaces of the first and second side walls.

10. The paint tray according to claim 7, further comprising a plurality of feet connected to an outer edge of the lip and extending downwardly from the outer edge of the lip, the plurality of feet configured to support and stabilize the paint tray on a support surface on which the paint tray is placed.

11. A paint tray for holding paint which is distributable onto a paint roller cover, the paint tray comprising:

a front wall disposed at a front end of the paint tray;

a rear wall disposed at a rear end of the paint tray;

first and second side walls extending longitudinally between the front and rear walls and connected to the front and rear walls;

a bottom wall connected to a lower edge of the rear wall and to lower edges of the first and second side walls;

an inclined ramp extending from the bottom wall to an inner surface of the front wall, the inclined ramp including:

a lower angled ramp face extending upwardly from the bottom wall at a first angle;

an upper angled ramp face connected to the lower angled ramp face and extending upwardly from the lower angled ramp face at a second angle which is different from the first angle, the upper angled ramp face extending to the inner surface of the front wall;

a first raised runner extending from the bottom wall to the inner surface of the front wall, the first raised runner having a lateral width thereof being greater than a vertical height thereof, the first raised runner including a first lower runner disposed on the lower angled ramp face and protruding from the lower angled ramp face so as to be raised relative to a central portion of the lower angled ramp face, the first raised runner further including a first upper runner connected to the first lower runner and disposed on the upper angled ramp face, the first upper runner protruding from the upper angled ramp face so as to be raised relative to a central portion of the upper angled ramp face, the first upper runner extending to the inner surface of the front wall;

a second raised runner laterally spaced apart from the first raised runner, the second raised runner extending from the bottom wall to the inner surface of the front wall, the second raised runner having a lateral width thereof being greater than a vertical height thereof, the second raised runner including a second lower runner disposed on the lower angled ramp face and protruding from the lower angled ramp face so as to be raised relative to the central portion of the lower angled ramp face, the second raised runner further including a second upper runner connected to the second lower runner and disposed on the upper angled ramp face, the second upper runner protruding from the upper angled ramp face so as to be raised relative to the central portion of the upper angled ramp face, the second upper runner extending to the inner surface of the front wall; and a recessed space defined between at least inner sides of the first and second raised runners and the central portions of the lower angled ramp face and the upper angled ramp face;

the paint tray further comprising:

a well including the bottom wall and bounded by at least the rear wall, the first and second side walls, the first and second lower runners protruding from the lower angled ramp face and the central portion of the lower angled ramp face, the well defining a region configured to hold paint pooled in the paint tray;

a first recessed gutter formed between the first side wall and the inclined ramp, the first recessed gutter configured to direct paint received therein into the well; and a second recessed gutter formed between the second side wall and the inclined ramp, the second recessed gutter configured to direct paint received therein into the well;

wherein the paint tray is configured such that when a paint roller cover is rolled along the inclined ramp, the first and second raised runners, together with the recessed space of the inclined ramp, increase the amount of paint distributed onto a center portion of the paint roller cover and decrease the amount of paint distributed onto ends of the paint roller cover.

12. The paint tray according to claim 11, wherein the first and second raised runners of the inclined ramp are disposed parallel to each other.

13. The paint tray according to claim 11, wherein the first and second raised runners of the inclined ramp are disposed parallel to the first and second side walls.

14. The paint tray according to claim 11, wherein the inclined ramp further includes a plurality of ramp treads configured to increase traction between the paint roller cover and the inclined ramp, thereby causing the paint roller cover to spin when the paint roller cover is rolled along the inclined ramp.

15. The paint tray according to claim 11, wherein each of the first and second raised runners of the inclined ramp further include a plurality of runner treads configured to increase traction between the paint roller cover and the inclined ramp, thereby causing the paint roller cover to spin when the paint roller cover is rolled along the inclined ramp.

16. The paint tray according to claim 11, further comprising a first elongate bumper connected to an inner surface of the first side wall and disposed adjacent to the first raised runner of the inclined ramp and a second elongate bumper connected to an inner surface of the second side wall and disposed adjacent to the second raised runner of the inclined ramp, the first and second elongate bumpers configured to wipe excess paint from at least side edges of the paint roller cover when the paint roller cover is rolled along the inclined ramp.

17. The paint tray according to claim 11, further comprising a lip connected to upper edges of the front and rear walls and to upper edges of the first and second side walls, the lip extending outwardly from the front and rear walls and the first and second side walls.

18. The paint tray according to claim 17, wherein the lip includes at least one concave rest formed thereon configured to support a handle of a paint roller frame when the paint roller frame is not in use.

19. The paint tray according to claim 17, further comprising a plurality of structural reinforcement ribs connected to a bottom surface of the lip, outer surfaces of the front and rear walls and outer surfaces of the first and second side walls.

20. The paint tray according to claim 17, further comprising a plurality of feet connected to an outer edge of the lip and extending downwardly from the outer edge of the lip, the plurality of feet configured to support and stabilize the paint tray on a support surface on which the paint tray is placed.

* * * * *